US006446362B1

(12) United States Patent
Martin et al.

(10) Patent No.: US 6,446,362 B1
(45) Date of Patent: Sep. 10, 2002

(54) MULTIPOSITION BOOT STRAP MOUNT

(75) Inventors: John D. Martin, Vashon; Jay G. Wailer, Edmonds; William B. Hall, Seattle, all of WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 09/766,157

(22) Filed: Jan. 18, 2001

(51) Int. Cl.[7] ..... A43B 5/00
(52) U.S. Cl. ..... 36/117.1; 36/50.5; 36/58.5
(58) Field of Search ..... 36/115, 117.1, 36/132, 50.5, 50.1, 58.5

(56) References Cited

U.S. PATENT DOCUMENTS

| | | | | |
|---|---|---|---|---|
| 211,111 A | | 1/1879 | Rush, Jr. | |
| 3,936,061 A | | 2/1976 | Wada | |
| 4,061,348 A | | 12/1977 | Carter | |
| 4,843,740 A | | 7/1989 | Walkhoff | |
| 4,955,149 A | | 9/1990 | Ottieri | |
| 5,634,648 A | | 6/1997 | Tonel et al. | |
| 5,906,058 A | * | 5/1999 | Rench et al. | 36/115 |
| 6,009,638 A | * | 1/2000 | Maravetz et al. | 36/115 |
| 6,056,300 A | * | 5/2000 | Carpenter et al. | 36/50.5 |
| 6,061,870 A | * | 5/2000 | Dodge et al. | 36/50.5 |
| 6,155,577 A | * | 12/2000 | Okajima | 36/117.1 |

* cited by examiner

*Primary Examiner*—M. D. Patterson
(74) *Attorney, Agent, or Firm*—Christensen O'Connor Johnson Kindness PLLC

(57) ABSTRACT

The present invention is directed to a strap assembly (150) for a sports boot (100), that includes a first strap (151) pivotally connected at one end to the boot heel portion (130), and a second strap (161) pivotally connected to the opposite side of the heel portion. A clasp (159) is provided that allows the first strap to be adjustably connected to the second strap. One or both of the straps are attached to the heel portion with a slider mechanism (180) that allows the proximal ends of the straps to be selectively adjusted. The slider mechanism includes a slider plate (181) attached to the boot upper (120) having a medial channel (184) with an elongate slot (186). A nut plate (200) is slidably disposed in the medial channel, and a screw (210) connects the strap to the nut plate.

14 Claims, 3 Drawing Sheets

MULTIPOSITION BOOT STRAP MOUNT

FIELD OF THE INVENTION

A strap assembly for sporting footwear, and in particular, adjustably positionable strap assemblies.

BACKGROUND OF THE INVENTION

In boots and other footwear for sporting activities, such as boots for skiing or snowboarding, inline skates, ice skates, and the like, a plurality of means for securing the user's foot in the boot are frequently provided. For example, it is common to provide both a lacing system for closing the forward opening in the boot upper, as well as one or more straps extending generally around the user's foot and/or ankle. In a typical arrangement, a two-part strap assembly attaches to either side of the boot heel portion, with a clasp or some other attachment mechanism that allows the straps to be adjustably connected with the straps disposed generally around the forward portion of the user's foot.

Such straps provide several advantages over boots having only a lacing system to secure the boot about the user's foot. Laces provide a convenient and familiar way for the user to tighten the boot to provide a comfortably fit and a relatively uniform tension along the length of the laces. Straps, on the other hand, are generally much more sturdily constructed than laces, and are designed to exert and withstand much larger axial forces. Straps therefore provide a tighter and more reliable coupling between the user's foot and the boot, and are less likely to break during use than are laces. Moreover, in boots having both straps and laces, the straps will take the large transient loads that may be generated during use, protecting the laces from being over-stressed and potentially broken.

Another advantage to the sturdier straps is that they allow the user to more tightly secure their foot within the boot. This is particularly important in sporting applications, because the tighter coupling provides the user with greater control. For example, in snowboarding the user controls the glide path down a snowy slope utilizing foot movements to rotate the board about its various axes. Accurate control of the snowboard requires that the user's feet be very securely retained in the boot, with minimal relative motion between the user's foot and the boot. In fact, sporting boots will often include a mechanism such as a ratchet to the clasp connecting the straps that provides leverage facilitate tightening of the straps.

A typical structure for a snowboard boot for use with step-in bindings includes an internal high back structure, including a rigid heel cup extending about the user's ankle with an ankle support disposed above the heel cup and flexibly or pivotally secured to the heel cup. Flexible diagonal connectors may be provided to couple the ankle support to the boot sole. In some sporting footwear an external heel cup may alternatively be provided.

The most common strap assembly for sporting footwear utilizes two straps, each connected on opposite sides of the boot in the heel region, the straps extending around the forward portion of the upper near the base of the user's ankle. A mechanism is provided, for example, a clasp and ladder strap arrangement, that permits the user to connect and tighten the two straps to each other, thereby pulling the user's foot securely into the heel cup. In some configurations the straps are connected relatively high on the heel portion of the boot, so that when the strap is tightened the forces in the straps are directed essentially backwards, generally parallel to the sole of the boot. In other configurations the straps are connected lower on the heel portion of the boot, so that when the strap is tightened a component of the forces exerted by the straps is directed downwardly, towards the sole of the boot.

The precise location of the connection between the straps and the boot is important to many users in the various sports utilizing such footwear, for several reasons. The location of the connection will effect the comfort of the boot to the user, and users may have differing preferences for the location of this strap connection. More importantly, the location of the strap connection will impact the flexibility of the ankle portion of the boot and, in particular, the connection between the ankle portion and the heel of the boot. A strap connection disposed higher on the boot will more closely couple rotation of the user's ankle to the boot heel position than will a lower strap connection. In certain activities, a user may prefer to have the strap connection high on the heel portion of the boot in some instances, and lower in other instances, for the same pair of boots. In snowboarding, for example, a less-flexible ankle portion may be preferred for technically challenging or high-speed runs, and a more flexible ankle portion may be preferred for performing tricks and acrobatic maneuvers. In these cases the user is forced to choose between acquiring multiple pairs of boots for each activity or utilizing a less-than-ideal boot for one or more applications.

SUMMARY OF THE INVENTION

The present invention is directed to a multiple position strap assembly for sporting footwear such as snowboard boots, ski boots, skates and the like, wherein position of the strap connection to the boot can be adjusted.

In an embodiment of the present invention, an adjustable strap assembly includes a first strap having a proximal end that is pivotally attached to the boot heel portion on one side, a second strap having a proximal end and that is pivotally attached to the boot heel portion on the opposite side, and a clasp mechanism for adjustably connecting the first strap to the second strap. A slider assembly is used to pivotally attach the straps to the boot heel portion, the slider assembly including a slider plate with an elongate channel having a slot therethrough and a nut plate slidably entrapped in the elongate channel. A screw extends through an aperture in the strap, and engages the nut plate to adjustably and pivotally attach the strap to the boot. The slider assembly allows the user to adjust the position of the straps, and thereby the direction of the forces that are applied by the straps.

In an embodiment of the present invention the elongate slot extends from a relatively high and rearward position on the heel to a relatively low and forward position on the heel.

In an embodiment of the present invention the elongate slot through the medial portion comprises alternating wider and narrower portions that are sized such that the engaged screw and nut plate can be slid between adjacent wider portions of the slot.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
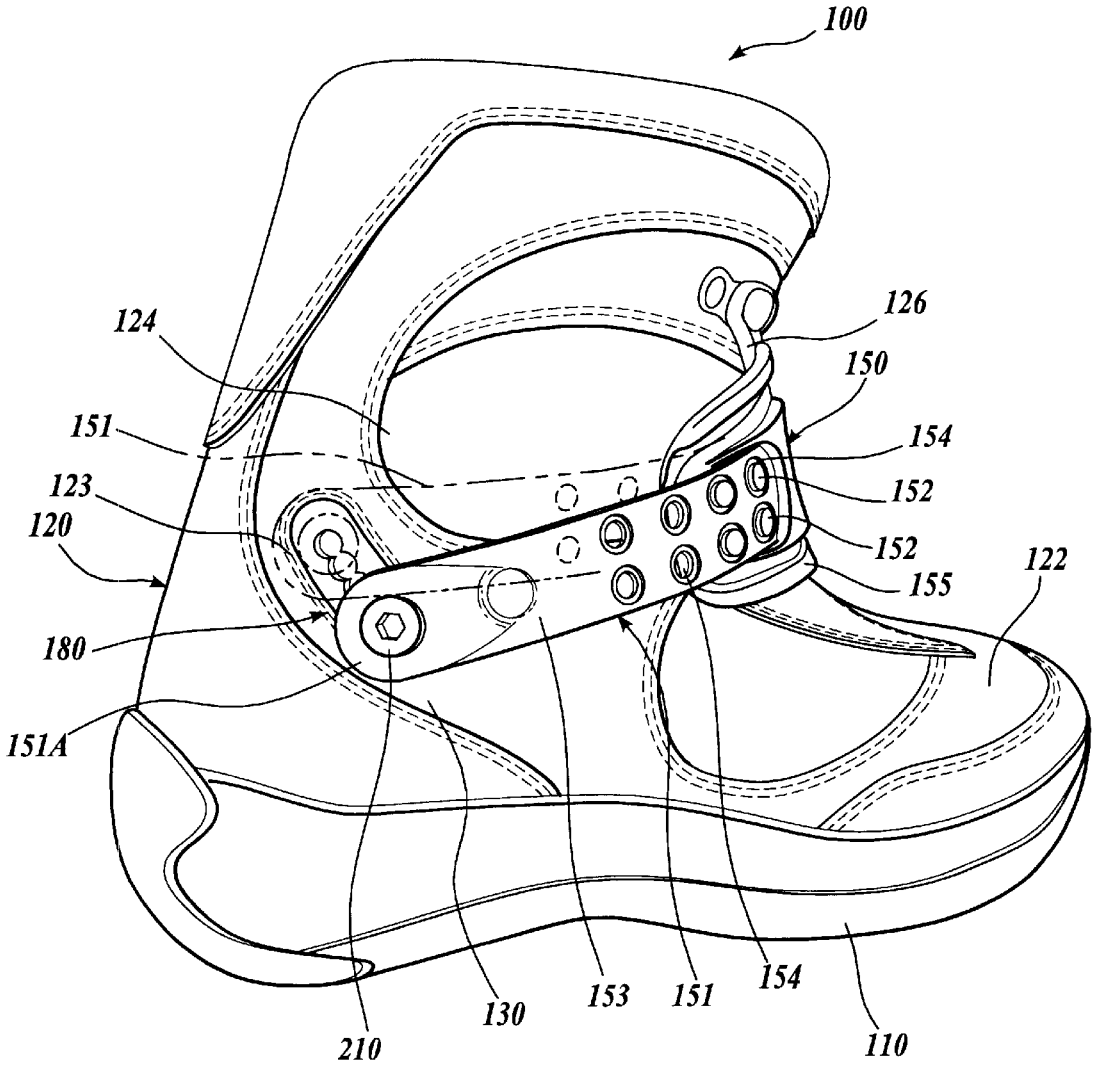
FIG. 1 is a perspective view of a boot having a strap assembly according to the present invention, showing the strap in the lowermost position, and showing the strap in phantom in the uppermost position.

A sports boot according to the present invention is shown in a perspective view from the lateral side in FIG. 1, showing a snowboard boot 100. The snowboard boot 100 includes a sole 110 disposed at the bottom of the boot 100 that underlies the user's foot (not shown) and an upper 120 attached to the top surface of the sole 110, that generally surrounds the user's foot and ankle. The upper includes a toe portion 122 and an ankle portion 124. The rearward portion of the upper 120 and the rearward portion of the sole 110 cooperatively form a heel portion 130. For purposes of this patent, the heel portion is defined to include the upper 120 includes a forwardly disposed opening (not shown) to facilitate receipt of the users foot, and a boot lace 126 for closing the opening, thereby securing the user's foot in the boot 100. The heel portion 130 may include a rigid or semirigid heel cup (not shown).

A strap assembly 150 is also provided. The strap assembly 150 includes a first strap 151 that extends from one side of the heel portion 130 and around the front of the ankle portion 124 of the upper 120, generally over a portion of the lace 126. In this embodiment the first strap 151 includes a relatively narrow proximal portion 153, and a wider, padded distal portion 155. The padded portion 155 can be positioned at the front of the boot 100, generally over the front of the user's foot. The wider and padded portion 155 of the first strap 151 increases the comfort to the user by spreading the forces exerted by the strap assembly 150 over a larger area. The padded portion 155 also includes a plurality of posts 152 extending generally perpendicular to the padded portion 155 outer surface and the narrow portion includes a plurality of corresponding apertures 154. The padded portion 155 is adjustably attached to the narrow portion 153 by inserting the posts 152 through a selected set of the plurality of apertures 154 in the narrow portion 153. The user can thereby adjust the total length of the first strap 151, and the relative axial position of the padded portion 155 of the first strap to maximize the user's comfort.

Figure 2:
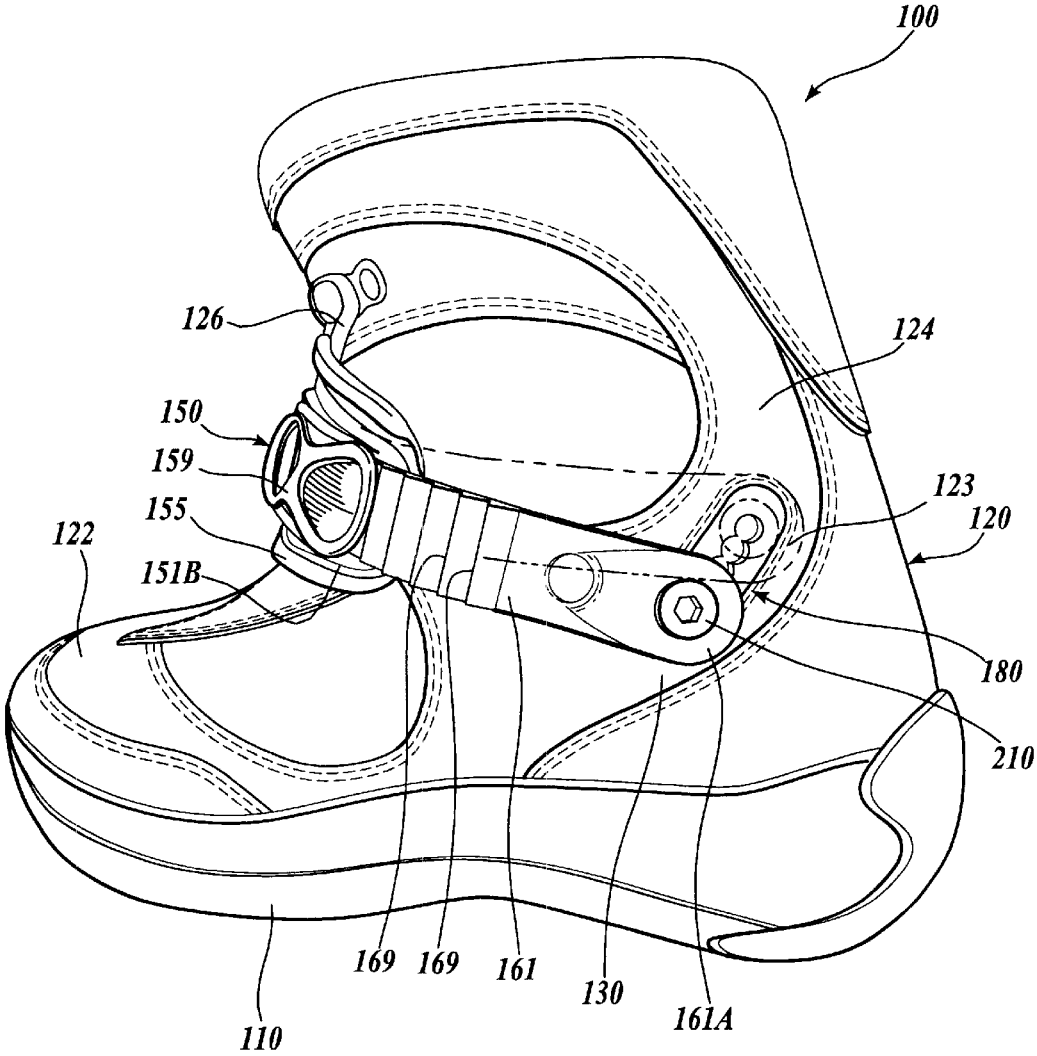
FIG. 2 is a perspective view of the boot of FIG. 1, generally from the opposite side.

Referring also to FIG. 2, which shows the boot 100 from the medial side, the strap assembly 150 further includes a second strap 161 having a proximal end 161A that connects to the heel portion 130 generally opposite the first strap proximal end 151A. In the disclosed embodiment, a ratchet-type clasp 159 is attached to the first strap distal end 151B. The second strap 161 is a ladder-type strap having a plurality of transverse ridges 169 that are engaged by the clasp 159 to adjustably connect the first strap 151 to the second strap 161. The ratchet clasp 159 includes a mechanism for tightening the straps 151, 161.

Figure 3:
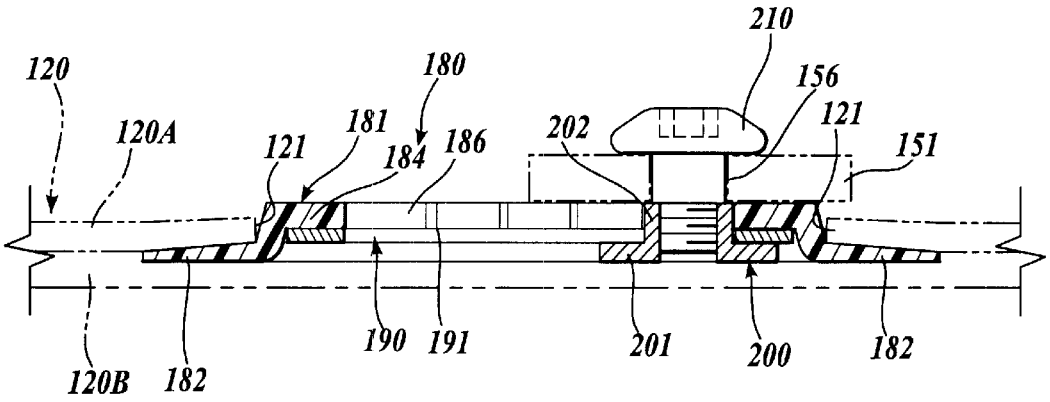
FIG. 3 is a cross section side view of the slider assembly shown in FIG. 1, and showing the strap, and boot panels in phantom.

As seen most clearly in FIG. 1, the first strap proximal end 151A, can be positioned in multiple positions on the heel portion 130. A slider mechanism 180 is provided in, or attached to, the heel portion 130. Referring now to FIG. 3, a cross-sectional view of the slider mechanism 180 is shown with fragmentary portions of the boot upper 120 and first strap 151 shown in phantom view. The slider mechanism 180 includes a slider plate 181 having a thin annular retention panel 182, and an elongate medial portion 184 projecting outwardly from the retention panel 182, and forming an elongate channel. An elongate slot 186 extends through the medial portion 184 of the slider plate 181. The slider plate 181 is preferable disposed between an outer panel 120A of the upper 120 and an inner panel 120B. Alternatively, a separate backing panel can be provided behind the slider plate 181. An aperture 121 is provided in the outer panel 120A sized to accommodate the medial portion 184 of the slider plate 181, whereby the slider plate 181 can be retained by the retention panel 182 in the upper 120 with the slot 186 accessible from outside the boot 100. In the disclosed embodiment, the slider plate 181 is secured to the upper 120 with stitches 123 (see FIG. 1), although any suitable method for securing the slider plate 181 to the upper 120 may be used.

A washer plate 190 and a nut plate 200 are disposed within the channel formed by the medial portion 184 of the slider plate 181, the washer plate 190 also having an elongate slot 191 therethrough, generally matching the slot 186 on the medial portion 184. The nut plate 200 includes a larger-diameter planar portion 201 and a tubular threaded portion 202 that extends vertically from the planar portion 201. The threaded portion 202 has a threaded inner surface. The length of the threaded portion 202 is selected to extend generally through the washer plate 190 and the slot 186 on the slider plate 181. The first strap 151 includes an aperture 156 near its proximal end. A screw 210 having a threaded post 212 is slidably inserted through the strap aperture 156, and engages the threaded portion 202 of the nut plate 200 to pivotally secure the first strap 151 to the slider plate 181 with a screw head 211. The screw head 211 includes an engagement aperture 214, such as a hex-shaped aperture or other conventionally keyed aperture, to facilitate tightening the screw 210. When the screw 210 is tightened, the nut plate 200 and screw 210 produce a clamping force, thereby locking the nut plate 200 in a selected position within the slot 186. If the user desires to change the position of the proximal end of the strap 151, the screw 210 is loosened, the strap 151 is pushed laterally to slide the nut plate 200 along the slot 186 to the desired position, and the screw 210 is retightened.

Figure 4:
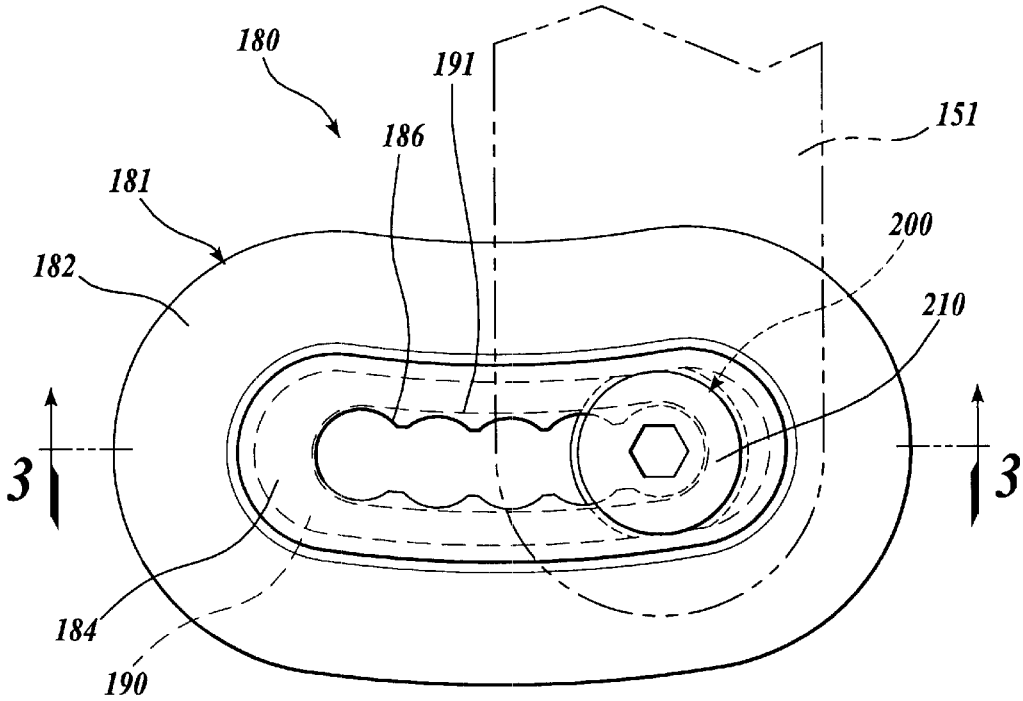
FIG. 4 is a plan view of the slider assembly shown in FIG. 1.

As seen most clearly in FIG. 4 in the disclosed embodiment, the slot 186 on the slider plate 181 has a variable width, approximating an overlapping array of generally circular apertures. The maximum diameter of the slot 186 is slightly greater than the diameter of the threaded portion 202 of the nut plate 200 whereby the nut plate 200 extends through the slot 186. The minimum slot width and the slider plate elasticity are selected to enable the nut plate 200 to be moved through the length of slot 186, with sufficient interference between the nut plate 200 and the narrow parts of the slot 186 to require the exertion of some force, so that the nut plate 200 will preferentially "snap" into discrete locations within the channel. It will also be appreciated from FIG. 4 that the retention panel 182 is large enough to spread the load induced by the tightened straps 151, 161 over a large area, thereby facilitating secure attachment of the slider plate 181 to the upper 200 and reducing the wear and tear on the upper 120.

It should be appreciated that although the described embodiment is currently preferred, the invention could be practiced without the slot having a variable width, and with no mechanism, or an alternate mechanism, for causing the nut plate 200 to preferentially acquire discrete positions within the channel. Similarly, any suitable device for attaching the first strap 151 to the slider plate 181 could be utilized, including by way of nonlimiting example, a threaded post extending upwardly from the slot, and encaptured behind the slider plate 181. Similarly, the slider plate could be attached to the upper using any of a number of attachment methods well known in the art, including for example, adhesives, rivets, staples, and the like. An advantage of the disclosed construction wherein the retention panel 182 is disposed underneath the outer layer of the boot upper 120, is that the medial portion 184 of the slider plate 181 does not project out significantly from the surface of the upper 120, and therefore the first strap proximal end 151A is generally directly adjacent the upper 120. The slider plate 181 is therefore less exposed to environmental factors that might otherwise damage or interfere with the operation of the slider mechanics in 180.

It is also contemplated by the present invention that in boots or other footwear having a rigid or semi-rigid heel cup, the slider plate may be formed integrally with the heel cup or fixedly attached to the heel cup. In such a construction the heel cup would provide a very secure structure for supporting the slider plate. The aperture 121 in the boot upper 120 would extend completely through the upper, positioned to receive the protruding medial portion 184 of the slider plate 181.

As shown most clearly in FIGS. 1 and 2, the slider plate 181 is positioned on the relatively high on the heel portion 130, with the slot 186 oriented generally diagonally from a relatively rearward and high location on the heel portion 130 to a relatively forward, and lower location. This preferred configuration allows the user to position the straps 151, 161 to be oriented approximately parallel to the sole 110 of the boot 100, when the nut plate 200 is moved to the highest position within slot 186. This position provides a stiffer ankle support, with the user's ankle flexure coupled more closely to the rearward portion of the sole 110. Alternatively, the user can move the nut plate 200 to a lower position, to increase the downward component of the forces exerted by the straps 151, 161 to achieve desired performance and comfort characteristics. The diagonal orientation of the slot 186 has been found to provide good anatomical and comfort characteristics throughout the range of positions that the straps 151, 161 can achieve.

It is also contemplated that the slider plate 181 may be contoured to approximately conform to the shape of the portion of the heel portion 130 where it is to be installed (and thereby to the general shape of the user's foot).

It will be appreciated that although the slider assembly has been described with reference to the first strap 151, it is contemplated as shown in FIG. 2, that a generally identical, but mirror image, of the slider assembly may also be provided for the second strap 161. In particular, it is believed that additional performance and comfort characteristics may be achieved by adjusting the first and second slider assemblies asymmetrically, for example with the left side slider in the highest position, and the right side slider in the lowest position. Additionally, for sporting footwear having more than one set of strap assemblies, this invention may be utilized for some or all of the straps.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A multiple position strap assembly comprising:

a boot having a heel portion;

a first strap having a proximal end and a distal end;

a second strap having a proximal end and a distal end, wherein the proximal end is attached to the boot;

cooperative means on the first and the second straps for releasably and adjustably connecting the first strap to the second strap; and a slider plate attached to the boot having an elongate medial portion forming a channel, the channel having an elongate slot therethrough that extends for a substantial portion of the length of the channel.

2. The multiple position strap assembly of claim 1, wherein the channel extends from a relatively high and rearward position on the heel portion to a relatively low and forward position on the heel portion.

3. The multiple position strap assembly of claim 1 wherein the slider plate further comprises an annular retention panel disposed about the periphery of the slider plate.

4. The multiple position strap assembly of claim 3, wherein the upper comprises an outer layer having an orifice, and an inner layer, and wherein the annular retention plate is disposed between the inner and the outer layer with the elongate medial portion projecting through the orifice in the outer layer of the upper.

5. The multiple position strap assembly of claim 3 further comprising a separate backing panel disposed behind the slider plate.

6. The multiple position strap assembly of claim 1 wherein the fastener comprises a nut plate having a planar base portion and a threaded center portion, and further wherein the attachment member comprises a screw having a threaded post that engages the threaded center portion of the nut plate.

7. The multiple position strap assembly of claim 6, wherein the first strap further comprises an aperture near its proximal end, and wherein the screw is inserted through the first strap aperture prior to engaging the nut plate, thereby pivotally securing the first strap to the slider base.

8. The multiple position strap assembly of claim 7, wherein the elongate slot through the channel comprises alternating wider and narrower portions, and wherein the engaged screw and nut plate form an intermediate shaft having a diameter that is smaller than the slot wider portion and larger than the slot narrower portion, and wherein the engaged screw and nut plate can be slid between adjacent wider portions of the slot.

9. The multiple position strap assembly of claim 7, further comprising a second slider plate with a slot, a second fastener slidably disposed within the slot, and a second attachment member adapted to engage the second fastener, whereby the second strap attachment to the boot can be slidably selected.

10. A boot for enclosing a foot, the boot having a forward toe portion, a rearward heel portion having a first side and a second side, an ankle portion having a forwardly disposed closable opening to facilitate receiving the foot, and a strap assembly for holding the ankle portion opening in a closed position, wherein the strap assembly comprises a first strap having a proximal end, a second strap having a proximal end, a clasp for adjustably securing the first strap to the second strap, and first attachment means for pivotally securing the proximal end of the first strap to the first side of the heel portion and second attachment means for pivotally securing the proximal end of the second strap to the second side of the heel portion, wherein said first and second attachment means permit the proximal end of the first and second straps to be moved between a first position lower on the heel portion and a second position higher on the heel portion, wherein the first attachment means comprises a slider base having an annular retention panel that can be attached to the upper, an elongate central portion including a channel with a slot therethrough, a nut plate having a threaded aperture, the nut plate being slidably encaptured within the channel such that the threaded aperture can be accessed through the channel slot, and a screw extending through the proximal end of the first strap prior to engaging the threaded aperture on the nut plate to pivotally attach the first strap to the boot.

11. The boot of claim 10, wherein the second attachment means comprises a slider base having an annular retention panel that can be attached to the upper, an elongate central portion including a channel with a slot therethrough, a nut plate having a threaded aperture, the nut plate being slidably encaptured within the channel such that the threaded aperture can be accessed through the channel slot, and a screw extending through the proximal end of the second strap prior to engaging the threaded aperture on the nut plate to pivotally attach the second strap to the boot.

12. The boot of claim 11, wherein the first and second attachment means are disposed on opposite sides of the heel portion, and wherein each slot extends from a higher position on the heel portion to a lower position on the heel portion, whereby the distal ends of the first and second strap can be moved from a high position wherein the straps are generally horizontally disposed to a low position wherein the straps are disposed at an angle with respect to horizontal.

13. A strap assembly comprising:

a boot having a sole and a high-back upper, wherein the sole and upper cooperatively form a heel portion having oppositely disposed apertures therethrough;

first and second slider plates disposed on opposite sides of the heel portion, the slider plates each having a retention panel, an elongate medial portion projecting upwardly from the retention panel thereby forming a channel, and a slot through the elongate medial portion, the slot having a plurality of narrow portions, wherein the upwardly medial portion of each slider plate projects through one of the heel portion apertures;

first and second nut plates, each nut plate slidably retained in one of the slider plate channels, each nut plate having a threaded portion that is accessible through, and generally perpendicular to the slider plate slot;

first and second threaded screws, each screw having a head and a shaft adapted to threadably engage at least one of the first and second nut plates;

a first strap having a proximal end with an aperture wherein the first screw is inserted through the aperture and engages the first nut plate thereby attaching the first strap to the first slider plate;

a second strap having a proximal end with an aperture wherein the second screw is inserted through the aperture and engages the second nut plate thereby attaching the second strap to the second slider plate; and a clasp disposed on said first strap and adapted to receive and retain the second strap.

14. A snowboard boot, comprising:

a sole;

an upper having a heel portion;

a first strap pivotally attached to the heel portion;

a second strap having a proximal end and a distal end, the second strap distal end being adapted to engage the first strap, and the second strap proximal end having an aperture therethrough;

a slider plate disposed on the heel portion generally opposite the second strap proximal end, including an elongate medial portion that forms a channel and having a slot therethrough that includes a plurality of narrow portions;

a nut plates having a threaded center portion and a planar base portion, the nut plate slidably retained in the slider plate channel whereby the threaded center portion extends at least part way through the slot and is impeded from sliding by the narrow portions of the slot; and a threaded screws having a head and a shaft adapted to threadably engage the threaded center portion of the nut plate;

wherein the screw extends through the second strap aperture and engages the nut plate to slidably retain the second strap.

* * * * *

UNITED STATES PATENT AND TRADEMARK OFFICE

CERTIFICATE OF CORRECTION

PATENT NO. : 6,446,362 B1
DATED : September 10, 2002
INVENTOR(S) : J.D. Martin et al.

It is certified that error appears in the above-identified patent and that said Letters Patent is hereby corrected as shown below:

Column 6,
Line 18, "claim 1" should read -- claim 1, --
Line 27, "claim 3" should read -- claim 3, --
Line 30, "claim 1" should read -- claim 1, --

Column 8,
Line 32, "a nut plates" should read -- a nut plate --
Line 38, "a threaded screws" should read -- a threaded screw --

Signed and Sealed this

Eighteenth Day of February, 2003

JAMES E. ROGAN
*Director of the United States Patent and Trademark Office*